US007887349B1

(12) United States Patent
Macomber

(10) Patent No.: US 7,887,349 B1
(45) Date of Patent: Feb. 15, 2011

(54) SAFETY ELECTRICAL RECEPTACLE

(75) Inventor: Joeseph Macomber, Naples, FL (US)

(73) Assignee: Breacher Boys, LLC, Naples, FL (US)

( * ) Notice: Subject to any disclaimer, the term of this patent is extended or adjusted under 35 U.S.C. 154(b) by 0 days.

(21) Appl. No.: 12/585,236

(22) Filed: Sep. 9, 2009

(51) Int. Cl.
*H01R 29/00* (2006.01)

(52) U.S. Cl. ..... 439/188

(58) Field of Classification Search ..... 439/188, 439/259, 261; 200/51.09, 51.1
See application file for complete search history.

(56) References Cited

U.S. PATENT DOCUMENTS

| | | | |
|---|---|---|---|
| 2,500,474 | A | 3/1950 | Sperrazza |
| 4,591,732 | A | 5/1986 | Neuenschwander |
| 4,707,042 | A | 11/1987 | Haden |
| 4,867,694 | A | 9/1989 | Short |
| 4,995,017 | A | 2/1991 | Sellati et al. |
| 5,095,182 | A | 3/1992 | Thompson |
| 5,113,045 | A | 5/1992 | Crofton |
| 5,267,870 | A | 12/1993 | Maresh |
| 5,320,545 | A | 6/1994 | Brothers |
| 5,387,761 | A | 2/1995 | Simonis |
| 5,426,552 | A | 6/1995 | Avitan |
| 5,928,019 | A | 7/1999 | Chen et al. |
| 6,111,210 | A | 8/2000 | Allison |
| 6,229,107 | B1 | 5/2001 | Flint et al. |
| 6,455,789 | B1 | 9/2002 | Allison |
| 6,749,449 | B2 | 6/2004 | Mortun et al. |
| 7,045,723 | B1 | 5/2006 | Projekovski |
| 7,070,432 | B1 | 7/2006 | Lin |

FOREIGN PATENT DOCUMENTS

| | | | |
|---|---|---|---|
| JP | 7065889 | A | 3/1995 |

*Primary Examiner*—Khiem Nguyen
(74) *Attorney, Agent, or Firm*—Tangent Law Group; Eric J. Weierstall, esq.

(57) ABSTRACT

A safety electric outlet receiving an electrical plug having a first live standard sized plug blade and second neutral standard sized plug blade including an outlet housing having at least two slots permitting the admission of the first and the second plug blade. A live side power supply coupled to the outlet and a neutral side of the outlet is provided. A first set of contacts coupled to the live side power supply and in a normally open state and supported on a first live side lever. A second set of contact is coupled to the live side through the first set of contacts and couples to the neutral side of the circuit in a normally open state supported on a second live side lever. A third set of contacts is coupled to the second and to the neutral side of the circuit in a normally open state on a first neutral side levers. A fourth set of contacts is coupled to the third set of at least four pairs of contacts and thereby couples the third set of contacts to neutral, the fourth set of contacts in a normally open state and supported on a second neutral side levers.

5 Claims, 6 Drawing Sheets

SAFETY ELECTRICAL RECEPTACLE

BACKGROUND OF THE INVENTION

1. Field of the Invention

This invention relates to fail safe electrical receptacles, more particularly, a fail safe electrical receptacle that provides power to an outlet only when a standard electrical plug is inserted into the outlet and the first blade entry makes contact with a neutral contact which then allows for the second blade to make contact and complete the circuit. Specifically, the instant invention electrical plug is energized when it causes at least two pairs of contacts to be coupled on a live side of the circuit which in turn engage a neutral contact that in turn couples to and is energized by a second set of an at least four pairs of contacts through the second prong that completes the circuit. Failure to engage the contacts results in no energization of the plug and engaging only the first set of the at least two contacts only engages the neutral contact, not completing the circuit resulting in no injurious shock.

2. Background of the Invention

Oftentimes, accidents occur in the home due to children inserting objects into power receptacles. If the child is lucky, he or she receives only a minor shock and learns to never insert anything other than an electrical plug into a power receptacle. However, more often than not, a child receives a severe shock, which may not only cause physical and psychological damage to the child, but may also cause physical damage to the home.

In order to help reduce the amount of these types of accidents in the home, a wide range of receptacle safety devices have been invented and used. For instance, the most common method of child safety proofing a receptacle is by inserting plastic safety plugs into an unused outlet. Although the outlet covers do provide protection, oftentimes the adults forget to reinsert the covers after using the outlet, thereby exposing the live outlet to the children.

In addition, a wide variety of shock resistant electrical outlets have been invented wherein power is not provided to the outlet unless the internal switches are triggered, via electrical plugs or other object, to an on position. In many instances, however, children become creative and insert two different foreign objects into the receptacle at once, thereby turning on both internal switches to complete a circuitry loop, resulting in the child getting shocked. That is, the circuit becomes hot from a non-standard plug blade or object that engages the internal switches.

In many circuits that require contact from the plug blade, the circuit setup activates when either blade is entered, thus a single blade is sufficient to complete the circuit. In theses instances, even though the fact that contacts need to be made viz a vis insertion of a single metallic object that might trip the contact points or switches. This can possibly lead to the completion of the circuit with a single prong like object. That is the circuit can go live as it does not complete the circuit through coupling of each side or prong side of the terminal to a set of neutral contacts first. Put another way, none of the existing devices require one prong to energize the other. Even in those that require both blades, there still exist scenarios in which non-standard single blade like device or two such non-standard blade like devices, like tweezers, could complete the circuit by completing contacts on either side of the receptacle.

Many of these existing designs rely on a circuit interrupter or similar device to trip and break the circuit. One mode in which these devices might fail is where insertion of the blade like object results in energization of the circuit and the breaker fails. The inclusion of breakers and similar devices also adds cost and complexity to the receptacle. Even in the embodiments that utilize switched circuits using the plug blade to complete a connection, as noted, these connections can be unsafely made. Thus, there exists the need for a receptacle which provides power or goes "hot" to only when a standard electrical plug is inserted into the outlet in both blade slots.

There are several examples of relevant patents on prior designs, these include the following patents:

| U.S. Pat. No. | Inventor | Issue/Pub. Date |
|---|---|---|
| 7,045,723 | Projkovski | May 16, 2006 |
| 2004/0067692 | Chevarie et al. | Apr. 8, 2004 |
| 2003/0124893 | Campbell | Jul. 3, 2003 |
| 2003/0085108 | Chiang et al. | May 8, 2003 |
| 2003/0045145 | Mortun et al. | Mar. 6, 2003 |
| 2002/0104745 | Allison | Aug. 8, 2002 |
| 6,455,789 | Allison | Sep. 24, 2002 |
| 6,111,210 | Allison | Aug. 29, 2000 |
| 5,387,761 | Simonis | Feb. 7, 1995 |
| 5,267,870 | Maresh | Dec. 7, 1993 |
| 5,113,045 | Crofton | May 12, 1992 |
| 4,995,017 | Sellati et al. | Feb. 19, 1991 |
| 4,951,732 | Neuenschwander | May 27, 1986 |
| 4,867,694 | Short | Sep. 19, 1989 |
| 4,271,337 | Barkas | Jun. 2, 1981 |
| 4,168,104 | Buschow | Sep. 18, 1979 |
| 3,846,598 | Mucsi | Nov. 5, 1974 |

With respect to U.S. Pat. No. 7,045,723 to Projkovski, the instant invention is a direct improvement in that it provides for safe operation without the need for a breaker and reduces the complexity of the device. The switches in the Projkovski patent do not engage in the manner herein described. There are additional switch elements, some of which are closed by default, and/or a breaker element to provide for the safety aspects in the receptacle and prevent the device from inadvertently becoming live. In contrast, the instant invention utilizes only open contacts, does not require a breaker to provide safer operation and can be manufactured at more easily and at a lower cost.

Although the prior art discloses many safety electrical receptacles, none has the same structure and operation as the present invention. None provides the positively claimed electrical coupling of an at least one pair of contacts on a live side to neutral and then another pair of contacts to the neutral on a neutral side to complete the circuit, the contacts only being engaged if a standard sized plug blade or prong is entered into the outlet and the circuit only being complete with two such standard blades.

SUMMARY OF THE INVENTION

An object of the present invention is to provide a fail safe electrical receptacle that provides power to an outlet only when a standard electrical plug is inserted into the outlet and only does so through coupling of a first set of contacts from the live side to neutral set of contacts and only then completes the circuit through the coupling the second of the at least two contacts to the set of neutral contacts.

A further object of the present invention is to provide a fail safe electrical receptacle that promotes child safety.

An even further object of the present invention is to provide a fail safe electrical receptacle that is cost efficient to manufacture.

A still further object of the present invention is to provide a fail safe electrical receptacle that is simple to manufacture.

An additional object of the present invention is to provide a fail safe electrical receptacle for use on temporary power poles for improving safety on construction sites.

The present invention fulfills the above and other objects by providing a fail safe electrical receptacle comprised of a receptacle having at least one outlet, the outlet having a neutral slot, a hot slot and a ground slot, at least two sets of normally open contacts and each set of contacts having at least one set of contact arms located on both the neutral side and hot side of the outlet. The circuit cannot go "hot" without both of the at least two sets of contacts associated with the "live" and "neutral" sides being coupled.

In an exemplary embodiment, the normally open sets of contacts are located above one another. When both prongs of a standard electrical plug are inserted into the outlet, the prongs make contact with all four contact arms, thus providing power to the electrical device. However, when an object is inserted into either of the slots, the object first makes contact with the switch levers. If the switch levers on only one or the other side are pressed against the normally open switches, a circuit is not completed as this would only couple to neutral and not complete the circuit to the other side of the circuit.

The invention includes an apparatus and a method of operation of an apparatus.

The apparatus of the invention includes a safety electric outlet that receives an electrical plug having a first live standard sized plug blade and second neutral standard sized plug blade, the outlet including an outlet housing having at least two slots permitting the admission of the first and the second plug blade. A live side power supply is coupled to the outlet. A neutral side of the outlet is provided. A first of an at least four sets of contacts is coupled to the live side power supply and are in a normally open state and supported on a first of an at least two live side levers. A second of an at least four sets of contacts coupled to the live side through the first set of an at least four sets of contacts and coupled to the neutral side of the circuit and in a normally open state supported on a second of an at least two live side levers. A third of an at least four sets of contacts is coupled to the second of the at least four sets of contacts and to the neutral side of the circuit and in a normally open state on a first of an at least two neutral side levers. And a fourth of an at least four sets of contacts is coupled to the third set of at least four pairs of contacts and thereby couples the third set of contacts to neutral, the fourth set of an at least four sets of contacts in a normally open state and supported on a second of an at least two neutral side levers, wherein the insertion of the live standard sized plug prong when it is admitted into the outlet housing engages the first and second of the at least two live side of levers and couples the first and second of the at least four sets of contacts to couple the powers supply on the live side of the circuit to neutral and the admission of the neutral standard sized plug prong into the outlet housing then engages the first and second of the at least two neutral side levers to engage the third and fourth of the at least four sets of contacts coupled to the neutral side of the circuit and complete the circuit and failure to admit a standard sized plug blade on either the live or neutral side of the outlet would result in a failure to complete the circuit and couple the respective side to neutral.

The first and second of the at least four sets of contacts can be a first set of contact pairs coupled to the power supply and a second set of contact pairs coupled to neutral on the live side of the outlet. The third and fourth of the at least four sets of contacts can be a third set of contact pairs and a fourth set of contact pairs on the neutral side of the outlet. The first standard sized plug blade and second standard sized plug blade can be sized to meet NEMA 5-15 specifications.

The method of the invention includes a method of operating a safety electric outlet by receiving an electrical plug having a first live standard sized plug blade and second neutral standard sized plug blade, comprising the steps of receiving first standard sized plug prong in a first side of the safety electrical outlet; moving a first of an at least two sets of live side levers with said first standard sized plug blade; engaging a first set of an at least two contacts to engage a live side of the circuit and simultaneously engaging a neutral set of contacts; receiving a second standard sized plug prong in a second side of the safety electrical outlet; moving a second of an at least two sets of levers with said first standard sized plug blade; engaging a second set of an at least two contacts with said second standard sized plug blade and engaging a second neutral set of contacts to complete the circuit, wherein failing to engage either of the at least two sets of contacts or either of the neutral set of contacts fails to complete the circuit.

The method of the invention further includes a method of operating a safety electric outlet receiving an electrical plug having a first live standard sized plug blade and second neutral standard sized plug blade, an outlet housing having at least two slots permitting the admission of the first and the second plug blade, a live side power supply coupled to the outlet, a neutral side of the outlet, a first of an at least four sets of contacts coupled to the live side power supply and in a normally open state and supported on a first pair of an at least two pairs of live side levers, a second of an at least four sets of contacts coupled to the neutral and in a normally open state supported on a second pair of an at least two pairs of live side levers, a third of an at least four sets of contacts coupled to the neutral side of the outlet and in a normally open state on a first pair of an at least two pairs of neutral side levers and a fourth of an at least four sets of contacts coupled to the neutral and in a normally open state supported on a second pair of an at least two pairs of live side levers, wherein the insertion of the live standard sized plug prong when it is admitted into the outlet housing engages the first of the at least two sets of levers and couples the first of the at least two sets of contacts to couple the live side of the circuit to neutral and the admission of the neutral standard sized plug prong into the outlet housing then engages the second pair of the at least two pair of levers to engage the second of the at least two sets of contacts coupled to the neutral side of the circuit and complete the circuit and whereby failure to admit a standard sized plug blade on either the live or neutral side of the outlet would result in a failure to complete the circuit and only couple one of the two sides to the neutral, the method comprising the steps of plugging in the first and second plug prong.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the drawings, where similar reference numerals refer to the similar features.

DETAILED DESCRIPTION OF THE INVENTION

Figure 1:
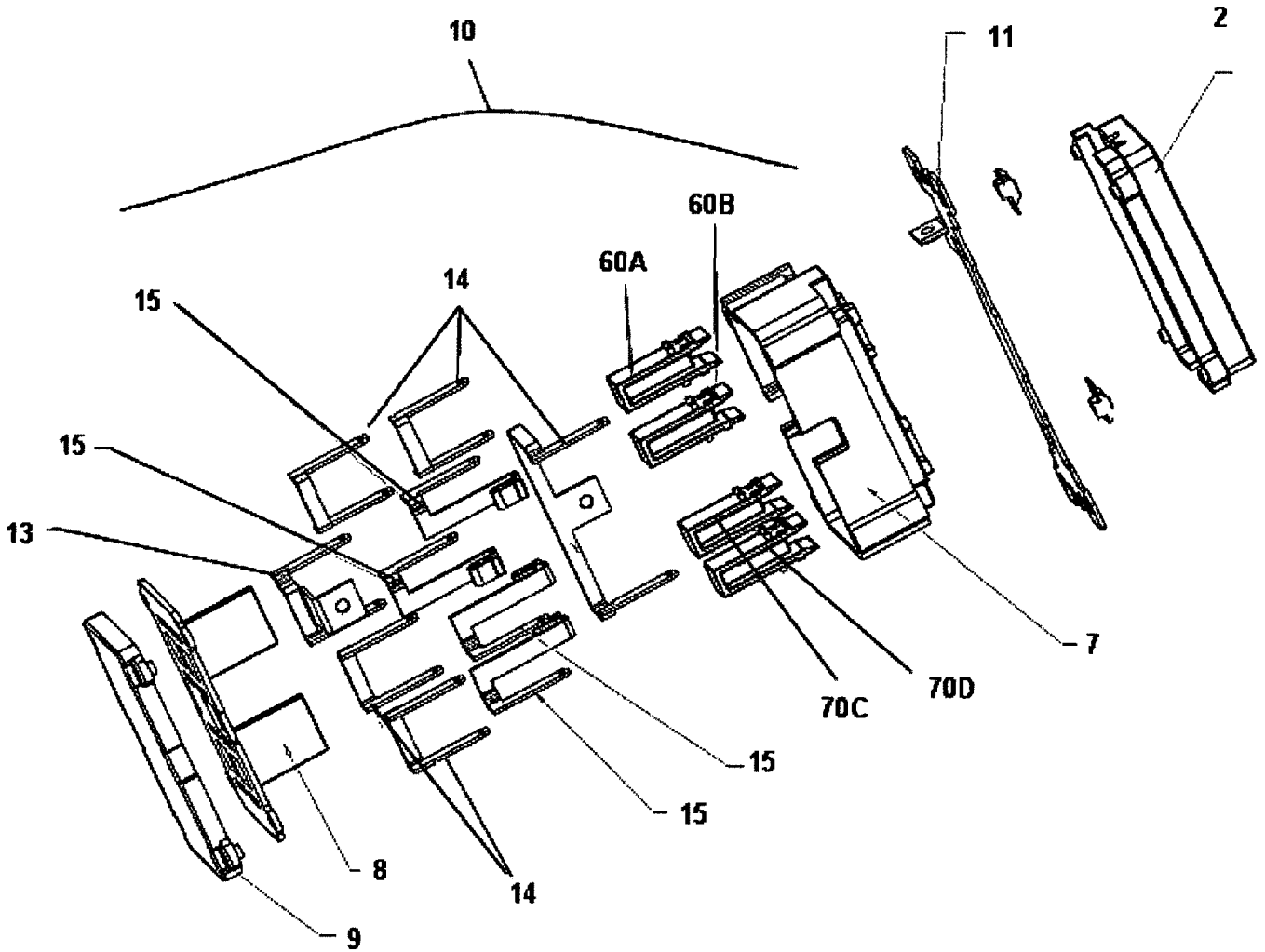
FIG. 1 shows an exploded view of the instant invention.
Figure 4:
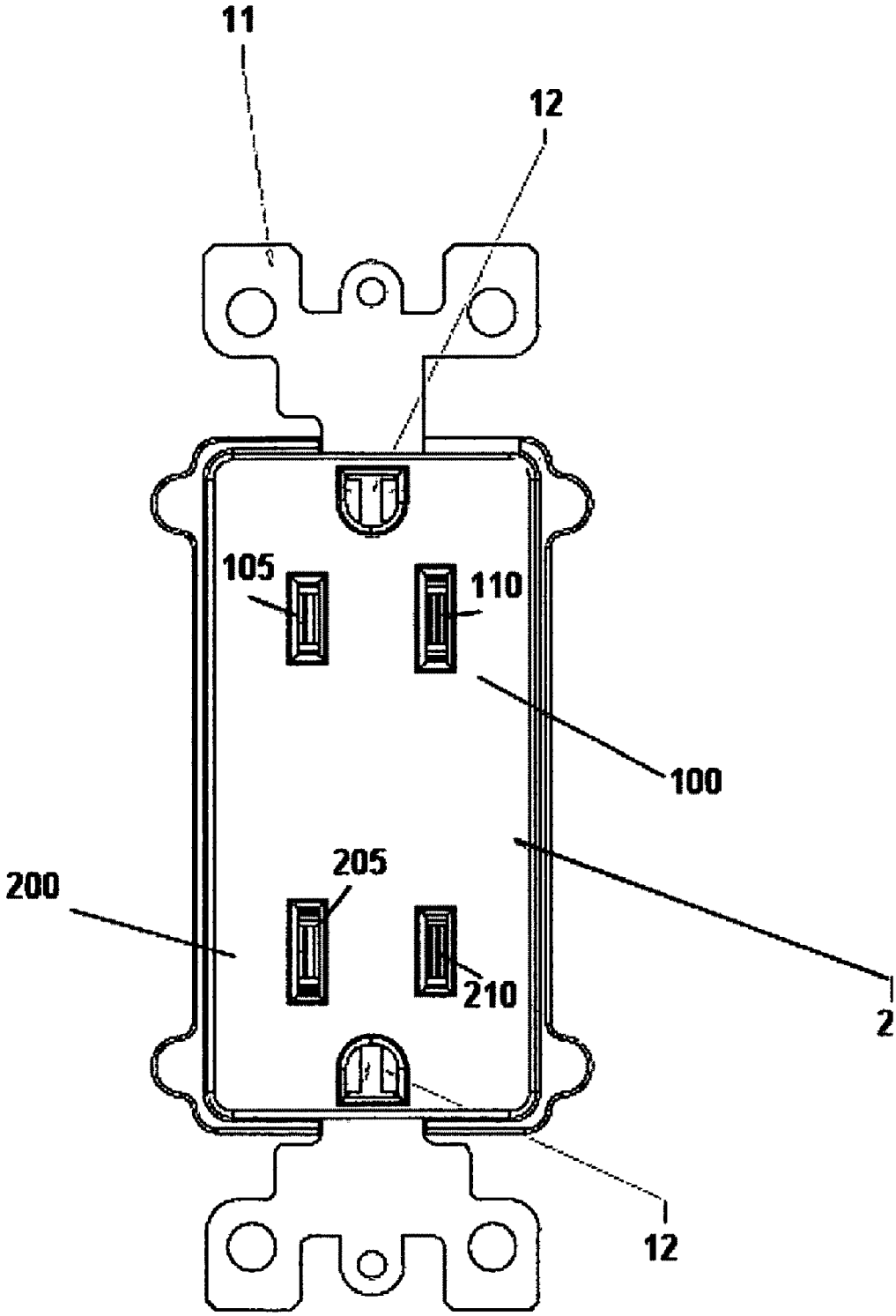
FIG. 4 shows a front view of an exemplary embodiment of the instant invention.

FIG. 1 shows an exploded view of an exemplary embodiment of the instant invention. The safety receptacle components are shown in the view. A safety receptacle 10 is shown. The receptacle has a housing 7 with a front cover 2 and a rear cover 9 and a mounting bracket 11. The bracket 11 permits for easy installation of the safety receptacle 10 in a standard wall socket space. Internally, the housing 7 contains the components for the two outlets that protrude through the front cover 2. The outlets 100, 200, as best shown in FIG. 4, are identical for the most part.

Figure 2A:
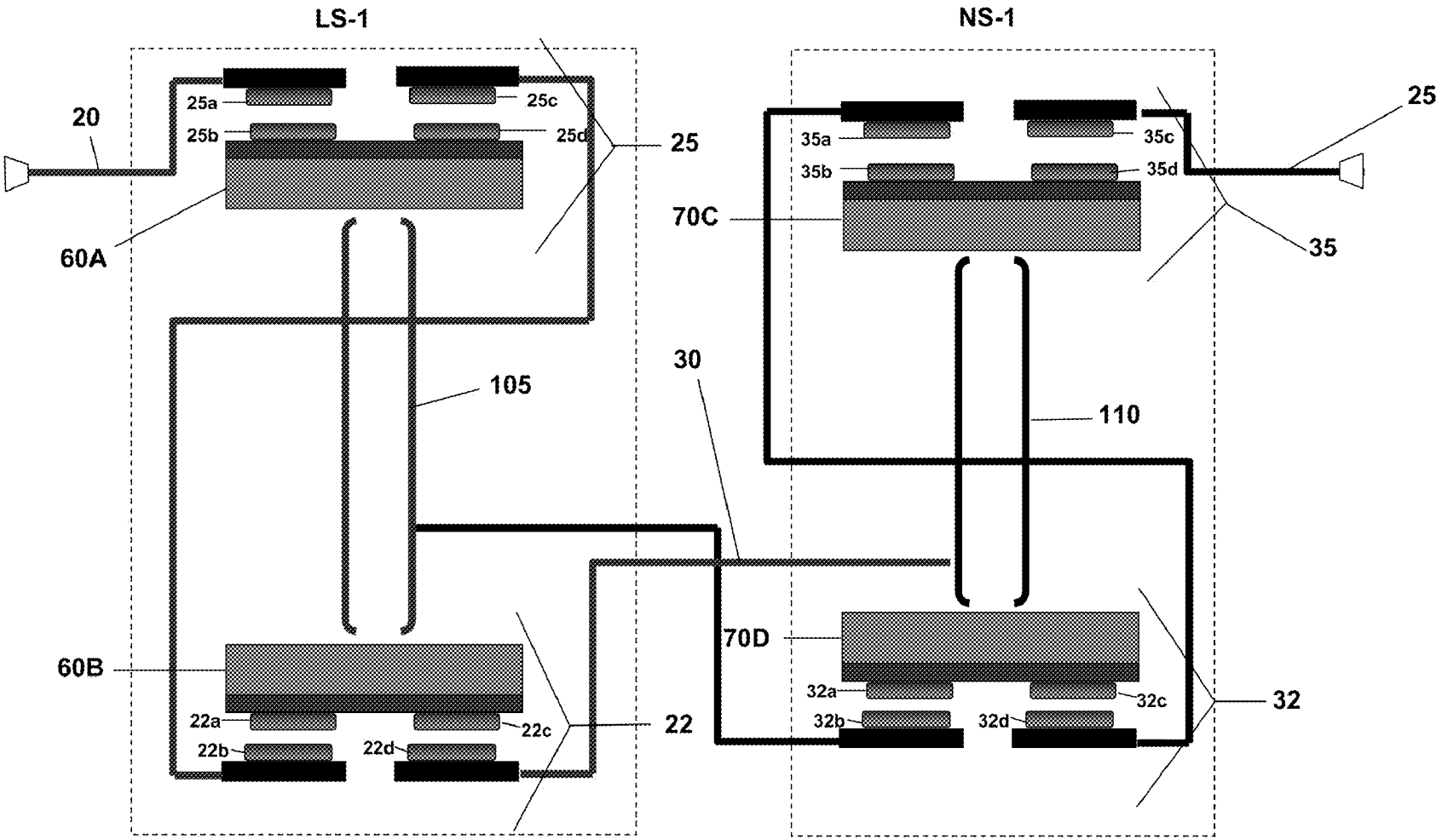
FIG. 2A shows plan view of an exemplary embodiment of the instant invention without the insertion of plug prongs.
Figure 2B:
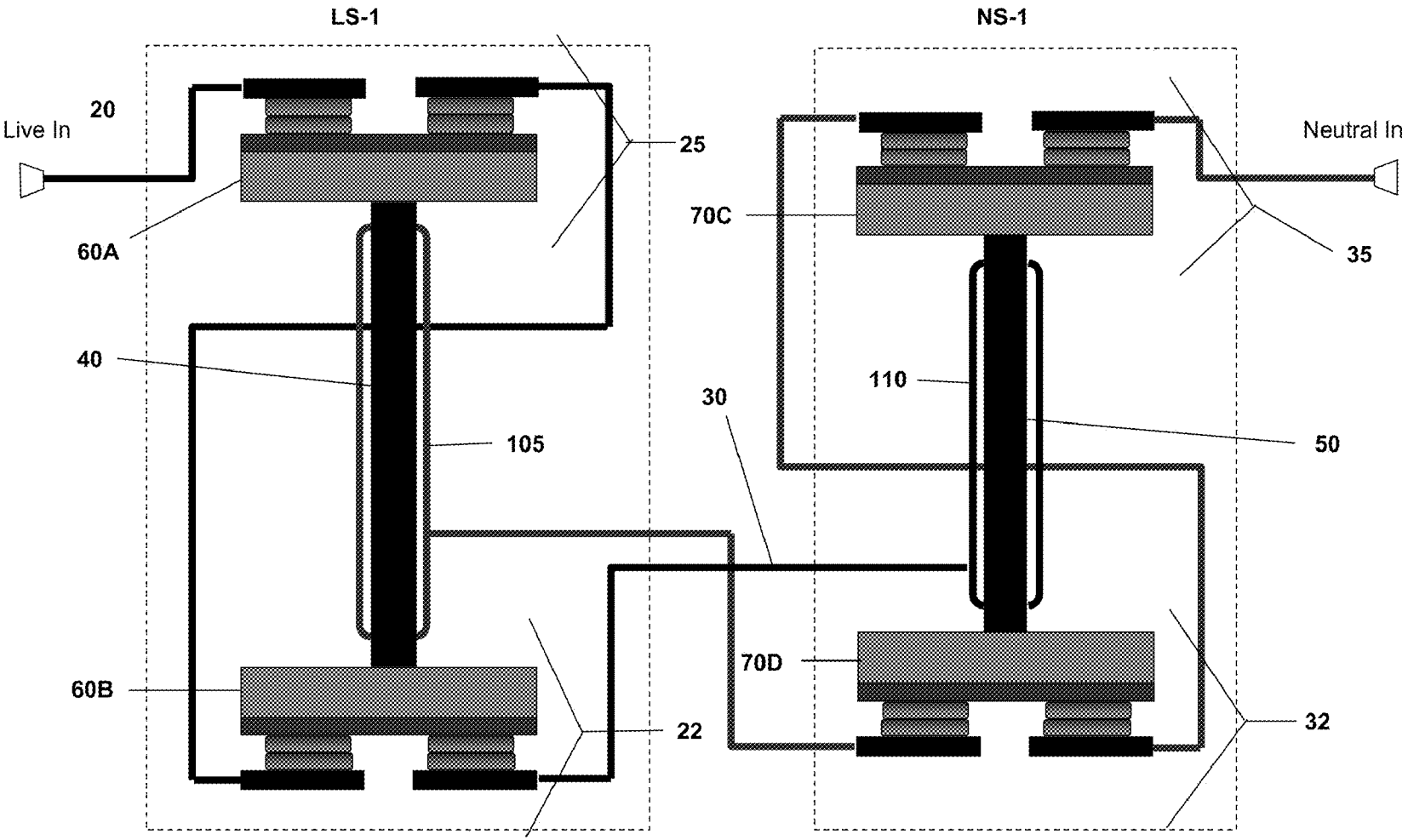
FIG. 2B shows plan view of an exemplary embodiment of the instant invention with the insertion of plug prongs.

The internal components include an at least four pairs of contacts 22, 25, 32, 35 for each outlet. Two of the at least four pairs of contacts 22, 25 are associated with the live side of the circuit that is coupled through the safety receptacle 10 and a further two of the at least four pairs of contacts 32, 35 are associated with the neutral side of the circuit, as best seen in FIGS. 2A-2B. These in turn are coupled to contact levers 60A, 60B, 70C, 70D as shown, these move when contacted by a plug blade 40, as further noted below. Contact pairs 22, 25, 32, 35 couple to a fixed support neutral 13. These levers and other components are supported by a contact retaining plate 8 that is contained within the housing 7. Additional components include blade contacts 15 and fixed contact elements 14 which are provided to engage and guide the plug prongs or blades 40, 50.

FIGS. 2A and 2B show a plan view of the circuit and contacts of an exemplary embodiment of the instant invention. FIG. 2A shows plan view of an exemplary embodiment of the instant invention without the insertion of plug prongs. Power originating from the building electrical distribution panel is connected to the safety electrical outlet 10 via a live terminal or live connection or live feed 20 and in turn connected directly to a first live contact section designated L-S1 with at least two sets of contacts 22, 25. Each of the at least two pair of contacts has contact elements 22*a*, 22*b*, 22*c*, 22*d*, 25*a*, 25*b*, 25*c*, 25*d*. A neutral feed 30 is connected to a first neutral contact section N-S1 in a similar manner, having at least two sets of contacts 32 and 35 and connected to ground with contact elements 32*a*, 32*b*, 32*c*, 32*d*, 35*a*, 35*b*, 35*c*, 35*d*.

The NEMA standards for plugs and plug prongs are varied and incorporated herein by reference. All NEMA 5 devices are three-wire grounding devices rated for 125 V maximum, with the 5-15, 5-20 and 5-30 being grounded versions of the 1-15, 1-20 and 1-30, respectively. The addition is a 3/16-inch (4.762 mm) diameter round or U-shaped ground pin, 1/8 in (3.175 mm) longer than the power blades and located 1/4 in (6.35 mm) below them. (1/4 in/6.35 mm is edge-to-edge; 15/32 in/11.906 mm center-to-center.) The 20A plug has the neutral blade rotated 90° and shifted so its inner edge is approximately 1/2 in (12.7 mm) from the hot blade. The 5-20R receptacle may have a T-shaped neutral hole, to accept both 5-15P and 5-20P plugs. The 5-30 and 5-50 are uncommon, as twist-locking plugs are generally used for high-current applications. They are larger, with 1 inch between power pins.

Without a first power plug blade or element 40, which can be for instance but is not limited to a NEMA 5-15 polarized or non-polarized standard plug blade, inserted into the safety electrical outlet 10 the electrical supply from the live feed 20 does not pass beyond the first live contact section L-S1. The 5-15R is by far the most common electrical outlet in North America in buildings built since the mid-twentieth century. It is usually installed in a duplex configuration (which may be on a common circuit or with each receptacle on a separate circuit, sometimes switched). The same applies to the neutral electrical feed connected directly to the switch section designated N-S1. Electrical power cannot pass beyond the first set of contacts in the respective sections L-S1 and N-S1, as the contacts are normally open and electrical power does not reach the live and neutral plug prongs. A first power plug blade or element 40 and a second power plug blade or element 50 enters the outlet 10. The power in the circuit will not engage until the blades are inserted to close the circuit.

FIG. 2B shows plan view of an exemplary embodiment of the instant invention with the insertion of a pair of standard plug prongs. With a power plug blade correctly inserted into the safety power receptacle 10 the prongs 40, 50 slide down into the power outlet or receptacle openings and the edges of the prongs come into contact with two pairs of electrically insulated wedge shaped levers 60A, 60B, 70C, 70D as seen in FIG. 2B. Wedge shaped levers 60A, 60B, 70C, 70D move the contact elements. The wedge shaped levers 60A, 60B, 70C, 70D are dimensioned and positioned in such a way that only a power plug prong 40,50, such as but not limited to a NEMA 5-15 standard plug prong, will successfully shift them and enable the live or neutral switch contacts 22, 25, 32, 35 to close. As the plug prongs 40, 50 travel deeper into the safety receptacle 10, the wedge shaped levers 60A, 70C spread apart and in so doing cause the electrical contacts 22, 25, 32, 35 to make or close the circuit.

Figure 2C:
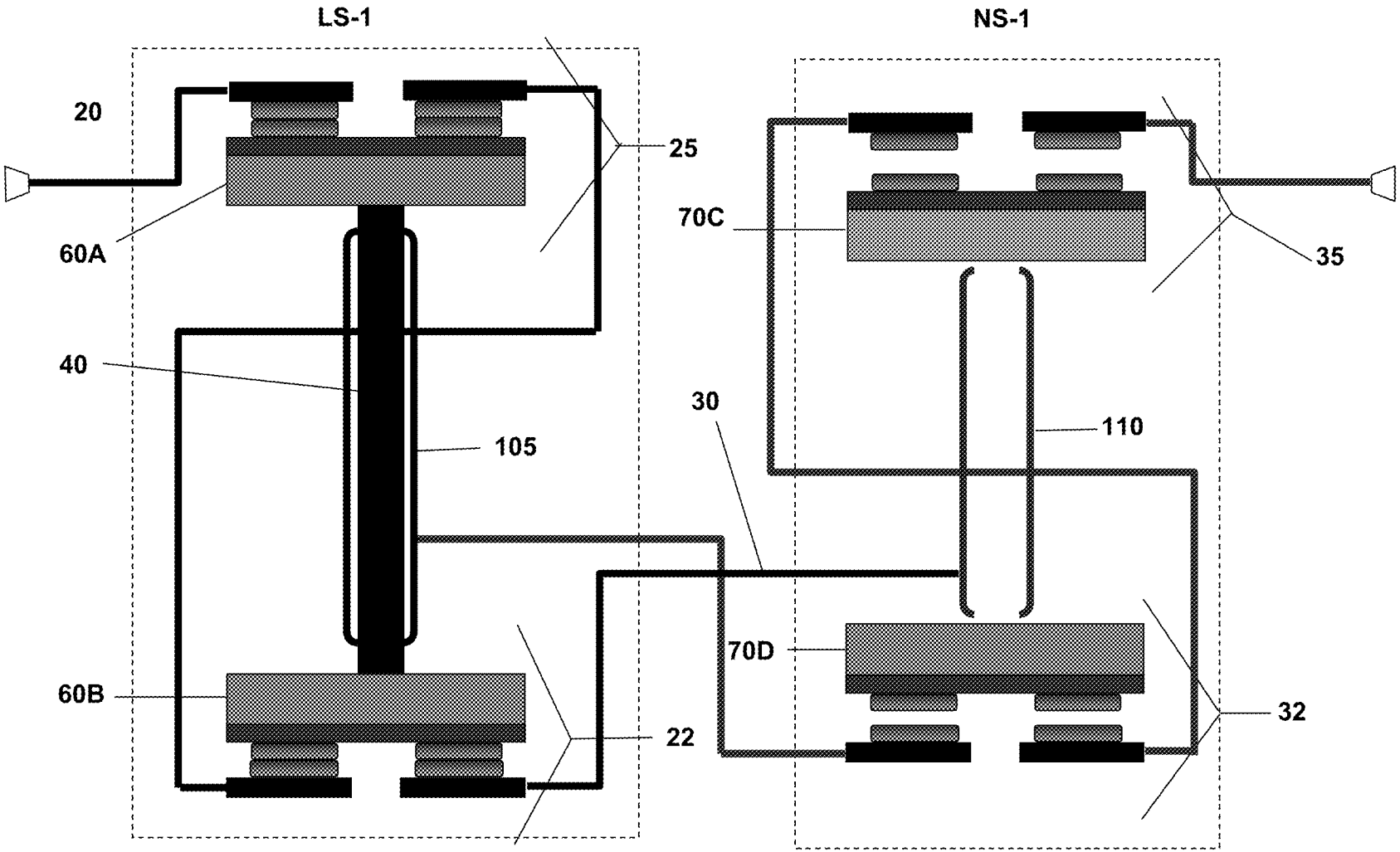
FIG. 2C shows plan view of an exemplary embodiment of the instant invention with the insertion of non-standard or single standard plug prong.

The N-S1 section has contacts 32*a*, 32*b*, 32*c*, 32*d*, 35*a*, 35*b*, 35*c*, 35*d* that are actuated by the power plug prong 50, these contacts close and supply power to the neutral plug prong contacts. Importantly, the plug cannot complete a circuit without the live side plug engaging the live side contacts L-S1 having contacts 22*a*, 22*b*, 22*c*, 22*d*, 25*a*, 25*b*, 25*c*, 25*d*. Without the properly sized plug blade or prong 40 and a similarly properly sized plug blade on the neutral side 50 the plug simply engages the neutral. As shown in FIG. 2C, if only the power plug prong 40 is engaged with the L-S1 contacts 22*a*, 22*b*, 22*c*, 22*d*, 25*a*, 25*b*, 25*c*, 25*d*. are actuated by the power plug prong 40 closing the contacts, and supplying power to the live plug prong contacts, but the contacts then couple to the ground contacts and do not complete the circuit since they are open. Even if one of the other two contact members 32, 35 are being depressed or motivated by another element, unless both are simultaneously moved by a plug or blade member of a standard plug prong size, no circuit is completed.

As can be seen in FIGS. 2A and 2B, as the power plug blades 40, 50 are admitted and moved into the into the safety power receptacle 10. The prongs 40, 50 slide down into the power outlet or receptacle openings 100, 110, 200, 210 and the edges of the prongs 40, 50 come into contact with at least two pairs of electrically insulated wedge shaped levers 60A, 60B, 70C, 70D. In the instant embodiment, each lever moves its set of contacts. Variations that would be within the spirit of the instant invention can include a further set of levers moving other elements and the number of contacts on each lever. This of course can be varied to include movement of both contact elements in the sets of contacts or the other sets of levers as further contemplated in further exemplary embodiments within the spirit of the instant invention. The levers 60A, 60B, 70C, 70D in turn move the pairs of contacts in the N-S1 and L-S1 sections together. This in turn powers the safety power receptacle 10. For the electrical outlet to be "hot", all eight of the contacts have to be closed at the same time to close the circuit. Thus the instant invention prevents the possibility of electrical hazard from insertion of a single prong like element without the need for a costly breaker or similar interrupt device.

FIG. 2C shows plan view of an exemplary embodiment of the instant invention with the insertion of non-standard or single standard plug prong. FIG. 2C shows a further plan view of the invention with only one prong or similar object inserted. Objects such as tweezers, small screw drivers, paper-clips, small files to name a few, being inserted into the electrical outlet opening would pose no electrical shock hazard as these objects would not close or enable all eight switch contacts. This is due to differences in the physical dimensions of these objects as compared to plug prong dimensions. As shown, even if the item is or is close to the correct dimensions or is a single prong, the engagement of either set of contacts L-S1 or N-S1 contact pairs will only couple to the neutral and the circuit will not be complete. There is no chance to receive a shock from the socket and no interrupter is needed, reducing the cost and complexity of the outlet.

Figure 3:
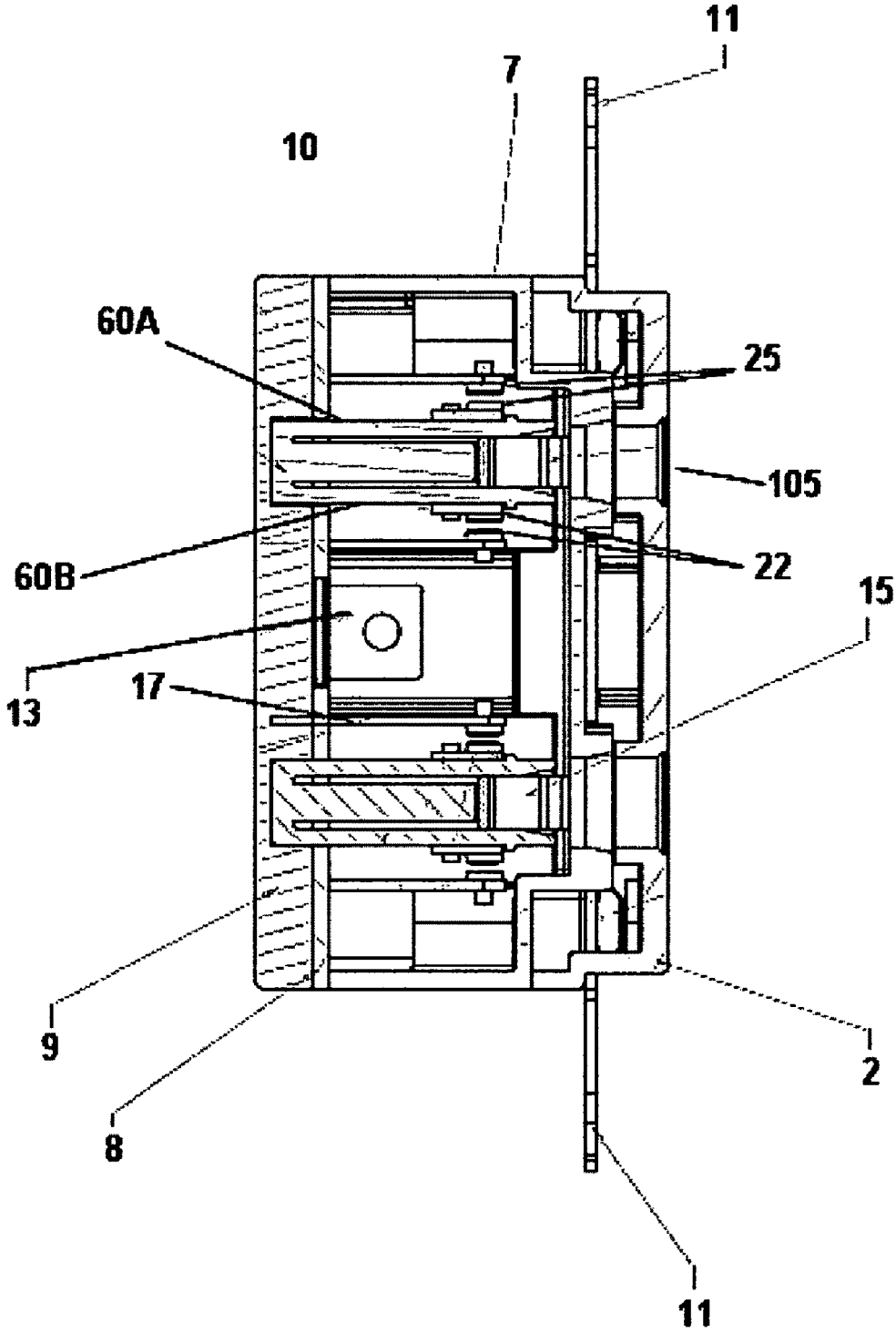
FIG. 3 shows a side view of an exemplary embodiment of the instant invention.

FIG. 3 shows a side view of an exemplary embodiment of the instant invention. Again, as can be clearly seen the safety power receptacle 10 is shown with an upper and a lower outlets 100, 200, the outlets 100,200 being identical in nature and components. From this view, only one contact side can be seen on the live side of the safety power receptacle 10. Until the plug blade 40 is admitted into the outlet 100 the contact members 22*a*, 25*a* remain open. When the plug blade 40 enters the outlet 15 it couples the live side contacts to the neutral. Similarly on the other side of the receptacle 10, not shown in this view, the neutral blade 50 moves the contacts on the N-S1 side of the receptacle to the neutral and completes the circuit. As noted above, the contacts remain open until the levers 60A, 60B, 70C, 70D are deflected by the blades 40, 50 and if one of the outlet slots 105, 110 is penetrated only on one side of the outlet 100 by a non-standard blade or similar instrument, the circuit will only couple to neutral and not complete the circuit as shown in FIG. 2C.

Because of these electrical interconnections, all four levers 60A, 60B, 70C, 70D on both slots 105 and 110 must be fully depressed in order to complete a full circuit, thereby providing power to the outlet. If an object, such as a screwdriver, is inserted into any one of the slots 105 or 110, the screwdriver would first make contact with the switch levers 60A, 60B, 70C, 70D, respectively, but would not complete the coupling of both sets of contacts 22, 25 or 32, 35. In this way, there is no chance of completing the circuit if only one blade or prong is inserted or even if one prong is inserted and a second non-standard element is used.

FIG. 4 shows a front view of an exemplary embodiment of the instant invention. The electrical receptacle 10 has at least one outlet 100, 200. The outlet 100, 200 comprises a neutral slot 12, a hot slot 105 and a ground slot 110, all of which may have receptacle cover 2, as also seen in FIG. 1 that will be in place and secured to the face of the electrical receptacle 10. A mounting bracket 11 is provided to easily install the electrical receptacle 10 into an existing wall opening. As can be seen in this view, the outward appearance and dimensions of the instant invention fit within the confines of a standard wall receptacle.

The embodiments and examples discussed herein are non-limiting examples. The invention is described in detail with respect to preferred embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. A safety electric outlet receiving an electrical plug having a first live standard sized plug blade and second neutral standard sized plug blade, comprising:

an outlet housing having at least two slots permitting the admission of the first and the second plug blade;

a live side power supply coupled to the outlet;

a neutral side of the outlet;

a first of an at least four sets of contacts coupled to the live side power supply and in a normally open state and supported on a first of an at least two live side levers;

a second of an at least four sets of contacts coupled to the live side through the first set of an at least four sets of contacts and coupled to the neutral side of the circuit and in a normally open state supported on a second of an at least two live side levers;

a third of an at least four sets of contacts coupled to the second of the at least four sets contacts and to the neutral side of the circuit and in a normally open state on a first of an at least two neutral side levers; and a fourth of an at least four sets of contacts coupled to the third set of at least four pairs of contacts and thereby coupling the third set of contacts to neutral, the fourth set of an at least four sets of contacts in a normally open state and supported on a second of an at least two neutral side levers, wherein the insertion of the live standard sized plug prong when it is admitted into the outlet housing engages the first and second of the at least two live side of levers and couples the first and second of the at least four sets of contacts to couple the powers supply on the live side of the circuit to neutral and the admission of the neutral standard sized plug prong into the outlet housing then engages the first and second of the at least two neutral side levers to engage the third and fourth of the at least four sets of contacts coupled to the neutral side of the circuit and complete the circuit and failure to admit a standard sized plug blade on either the live or neutral side of the outlet would result in a failure to complete the circuit and couple the respective side to neutral.

2. The outlet of claim 1, wherein the first and second of the at least four sets of contacts comprises a first set of contact pairs coupled to the power supply and a second set of contact pairs coupled to neutral on the live side of the outlet.

3. The outlet of claim 2, wherein the third and fourth of the at least four sets of contacts comprises a third set of contact pairs and a fourth set of contact pairs on the neutral side of the outlet.

4. The outlet of claim 1, wherein the first standard sized plug blade and second standard sized plug blade are sized to meet NEMA 5-15 specifications.

5. A method of operating a safety electric outlet receiving an electrical plug having a first live standard sized plug blade and second neutral standard sized plug blade, an outlet housing having at least two slots permitting the admission of the first and the second plug blade, a live side power supply coupled to the outlet, a neutral side of the outlet, a first of an at least four sets of contacts coupled to the live side power supply and in a normally open state and supported on a first pair of an at least two pairs of live side levers, a second of an at least four sets of contacts coupled to the neutral and in a normally open state supported on a second pair of an at least two pairs of live side levers, a third of an at least four sets of contacts coupled to the neutral side of the outlet and in a normally open state on a first pair of an at least two pairs of neutral side levers and a fourth of an at least four sets of contacts coupled to the neutral and in a normally open state supported on a second pair of an at least two pairs of live side levers, wherein the insertion of the live standard sized plug prong when it is admitted into the outlet housing engages the first of the at least two sets of levers and couples the first of the at least two sets of contacts to couple the live side of the circuit to neutral and the admission of the neutral standard sized plug prong into the outlet housing then engages the second pair of the at least two pair of levers to engage the second of the at least two sets of contacts coupled to the neutral side of the circuit and complete the circuit and whereby failure to admit a standard sized plug blade on either the live or neutral side of the outlet would result in a failure to complete the circuit and only couple one of the two sides to the neutral, comprising the steps of:

plugging in the first and second plug prong.

* * * * *